US007109506B2

(12) United States Patent
Papaioannou et al.

(10) Patent No.: US 7,109,506 B2
(45) Date of Patent: Sep. 19, 2006

(54) MICRO BEAM COLLIMATOR HAVING AN IRIS LIKE CAPILLARY FOR COMPRESSING BEAMS

(75) Inventors: Dimitrios Papaioannou, Stutensee-Blankenloch (DE); Christos Papaioannou, Karditsa (GR); Heinz Stutz, Eggenstein (DE)

(73) Assignee: Euratom, (BE)

( * ) Notice: Subject to any disclaimer, the term of this patent is extended or adjusted under 35 U.S.C. 154(b) by 0 days.

(21) Appl. No.: 10/516,272

(22) PCT Filed: May 16, 2003

(86) PCT No.: PCT/EP03/50174

§ 371 (c)(1),
(2), (4) Date: May 27, 2005

(87) PCT Pub. No.: WO03/102533

PCT Pub. Date: Dec. 11, 2003

(65) Prior Publication Data

US 2005/0224727 A1 Oct. 13, 2005

(30) Foreign Application Priority Data

May 31, 2002 (EP) ..... 02012122

(51) Int. Cl.
*G21K 1/02* (2006.01)
*G21K 1/04* (2006.01)

(52) U.S. Cl. ..... 250/505.1; 250/251; 378/147

(58) Field of Classification Search ..... None
See application file for complete search history.

(56) References Cited

U.S. PATENT DOCUMENTS

| | | | |
|---|---|---|---|
| 3,487,218 A | 12/1969 | Krebs et al. | |
| 4,754,147 A | 6/1988 | Maughan et al. | |
| 5,001,737 A | 3/1991 | Lewis et al. | |
| 2004/0013236 A1* | 1/2004 | Papaioannou et al. | 378/147 |

FOREIGN PATENT DOCUMENTS

| | | |
|---|---|---|
| EP | 0 817 208 A1 | 1/1998 |
| EP | 1 193 492 A1 | 4/2002 |
| GB | 1083402 | 9/1967 |

OTHER PUBLICATIONS

International Search Report for Application No. PCT/EP 03/50174 dated Nov. 27, 2003.

* cited by examiner

*Primary Examiner*—Nikita Wells
(74) *Attorney, Agent, or Firm*—Cantor Colburn LLP

(57) ABSTRACT

"A micro beam collimator for compressing beams is described, where the collimator has channel means for providing a channel having a cross section and guiding the beams from an entrance end to an exit end of the channel. The invention provides a micro beam collimator for compressing beams which allows easy adjustment of the width of the cross section of the beams while making it possible at the same time to adjust the length of the cross section of the beams. The invention forms the channel means by at least three rod members each of which having at least one bordering surface for bordering the cross section, wherein the rod members are moveable against each other along the bordering surfaces so that the geometry of the cross action is variable."

20 Claims, 4 Drawing Sheets

MICRO BEAM COLLIMATOR HAVING AN IRIS LIKE CAPILLARY FOR COMPRESSING BEAMS

BACKGROUND OF THE INVENTION

The present invention relates to a micro beam collimator having an iris like capillary for compressing or concentrating beams. The invention is applicable for the formation of X-ray micro beams or neutron micro beams. Further fields of application are X-ray lithography and the fabrication of miniature mechanical devices.

It is known in the art to use a glass capillary for the formation of X-ray micro beams to provide high resolution in many studies related to material characterization. All prior art developments rely on the principal of total multiple reflections of X-rays from the smooth internal glass capillary surface.

High-resolution X-ray examination on ultra small regions of materials extended the application of numerous laboratory and industrial techniques, such as diffraction, spectroscopy, fluorescence, as well as metal refining, semiconductor and ceramic manufacturing [see prior art references 1,2]. The increasing interest in X-ray microanalysis in many research and commercial fields yielded an intensive demand on methods for formation of X-ray micro beams. Nevertheless the most popular technique still remains the use of glass capillaries with various shapes of longitudinal cross section (usually tapered of parabolic) either single as mono-capillary or bundled as poly-capillary concentrators.

The generation of high intensity X-ray beams in the micrometer size is succeed through the multiple total reflection of X-rays [see prior art references 5,6] inside lead-glass capillary tubes [see prior art references 1–4,7,8]. By directing the source X-rays towards the capillary entrance, the incident beam may compressed as long as the angle of incidence for each reflection remains below the critical value $\theta_c$ which is calculated in the simplified form to $\theta_c=(2\delta)^{1/2}$ and $\delta=(Ne^2\lambda^2Z\rho/(2\pi mc^2A)$, where N=Avogadro's number, e=electron charge, $\lambda$=wave length of radiation, Z=atomic number, $\rho$=material density, m=electron mass, c=velocity of light and A=atomic mass [see prior art references 3, 4].

For lead glass and X-ray photons of 8 KeV, $\theta_c$ does not exceed 3 mrad (0.17°) [see prior art reference 9]. This means that a tapered lead glass capillary about 10 cm long will be limited to an entrance opening of about 20–50 μm if an output beam size of 3–11 μm is required [see prior art references 1,7]; the capillary capture tip must be even smaller for higher photon energies. Hence, only a small fraction of the incident radiation can be condensed, resulting that micro beam experiments usually being conducted at high-energy synchrotron radiation sources with high input X-ray intensities.

A possible way to increase the amount of radiation that can be condensed is to use reflecting materials with higher $\theta_c$ and better properties in the X-ray optics. Ideal materials for such a purpose are the heavyweight metals with high electron densities. Of course, construction of a metallic capillary tube in the style of the classic glass capillary with very smooth inner wall is extremely difficult.

The above mentioned difficulty has been overcome by the micro beam collimator for high resolution XRD investigations according to EP 1 193 492 A1. The known micro beam collimator has a channel for compressing X-ray beams being formed by two opposite, polished, oblong plates made of one of the heavyweight metals or materials having total reflection properties comparable to those of the heavyweight metals. The channel for guiding and compressing the beams has a line- or slit-shaped rectangular cross section. Spacer foils of different thickness can be used depending on the required widths of the generated beam. However, changing the width of the cross section of the channel by replacing the spacer foils is a complicated and time consuming process. Further, the known micro beam collimator does not allow an adjustment of the lengths of the cross section of the channel which is required in some applications.

BRIEF SUMMARY OF THE INVENTION

The invention provides a micro beam collimator for compressing beams which allows easy adjustment of the width of the cross section of the beams while making it possible at the same time to adjust the length of the cross section of the beams.

This technical problem is solved by a micro beam collimator having the features of claim 1. Further features of the present invention are disclosed in the subclaims.

According to the present invention a micro beam collimator having channel means formed by at least three rod members is proposed. Each of the rod members has at least one plane longitudinal bordering surface for bordering the cross section of the channel for guiding and compressing the beams. The plurality of all bordering surfaces is completely bordering the cross section of the channel along its complete length. Further, the rod members are moveable against each other along said bordering surfaces and in substantially radial directions so that the geometry, i.e. preferably the width and the length, of the cross section can be easily adjusted.

The number of rod members used in the present invention may be three, four, five or more. Preferably, four rod members having four bordering surfaces for completely enclosing the cross section of the channel are employed. The movements of the bordering surfaces of the rod members in substantially radial directions are sliding movements during which the bordering surfaces are preferably in contact with each other. Since the configuration and movement of the rod members are reminiscent of the configuration and movement of an eye-iris the channel or capillary formed by the rod members according to the present invention is called iris-capillary.

The iris-capillary, i.e. the plurality of rod members of the present invention, may be mounted in a supporting tube for protection against environmental influences, in particular physical external forces. A radial, preferably annular shaped space between the outer surfaces of the rod members and the inner surface of the supporting tube is provided to allow the substantially radial movements of the rod members for adjusting the geometry of the cross section.

According to the present invention it is possible to have both holding means for slidably holding the rod members within the supporting tube and adjustment means for effecting the movements of the rod members in substantially radial directions for varying the geometry of the cross section. However, it is advantageous to perform both the holding and the adjusting function by adjustment means only. Consequently, the number of parts of the micro beam collimator is reduced.

The adjustment means are provided at the entrance end and at the exit end of the channel or iris capillary. Preferably, further adjustment means may be provided in the axial middle portion of the channel. An example of adjustment means are screws which are penetrating the wall of the supporting tube and can be turned by hand or by any kind of additional tools as for example conventional screw drivers.

The rod members for forming the iris capillary according to the present invention can be bendable and/or twistable. The feature of being bendable allows adjusting of different sizes of the cross section of the channel at both its entrance end and its exit end. The feature of being twistable allows adjusting of the orientation of the cross section of the channel at both the entrance end and the exit end. As a consequence, the iris capillary is twisted as a whole.

Considering only the specific case of X-ray concentration and formation of intense micro beams, some technical characteristics of the invention will be presented now.

The iris capillary is preferably consisted of polished tungsten rod members with high critical angle for X-ray total reflection. For Cu $K\alpha_1$ X-ray photons (8.05 KeV) tungsten has $\theta_c$=0.574°, much higher than glass or lead glass, resulting that an iris capillary of the same length as a glass tube can be allowed to have 3.4 times larger radiation inlet aperture at the entrance end of the channel. As well as tungsten, the rod members can be also made from other noble high electron density metal, such as nickel, gold or platinum. Galvanic coating of machined bronze rod members by one of these metals is also a very good alternative solution.

In addition, metals exhibit higher mechanical strength than glass, allowing more stable and longer capillary constructions. Without significant technical expense, a capillary twice as long as the usual glass capillaries may be obtained according to the present invention. Both longer construction and high critical angle properties combine to allow a 6–7 times larger radiation entrance aperture than glass capillaries and, therefore, a much larger portion of the incident beam is intersected by the concentrator.

Comparing the iris capillary to conventional tubes shows the very important advantage of the variable apertures. Depending on the wavelength of the incident radiation and the working parameters, the entrance and exit tips can be easily adapted to obtain maximum intensity gain at nominal aperture dimensions from some microns (depending on the fabrication quality of the bordering surfaces of the rod members) up to some millimeter. The shape of the generated micro beam can be changed to point or slit cross sections according to experiment requirements.

Additional advantages in comparison to glass capillaries can be reported. Through the relatively thick walls formed by the rod members no losses (escape) of the concentrated radiation have been observed. Also, no strong heat effects can be detected, therefore the selected aperture dimensions remain unchanged during the experiment.

The metallic iris capillary has been mainly developed to be used as an X-ray concentrator for generation of micro beams and to substitute, where more convenient, the glass capillaries. The application field, as can be clearly understood, is very extensive. Variations and changes of the proposed configuration can be of course adapted to each individual case; the cross section shapes of the rod members for instance could be triangular or quadrate.

Depending on the experiment requirements and the available device, the iris capillary can be mounted on a gimbals system able to be used with the conventional laboratory X-ray radiation source of a classical powder diffractometer. An appropriate gimbals system as such is for example known form EP 1 193 492 A1. Such a gimbals system allows fine vertical and tilt adjustment of the iris capillary for the necessary alignment on the radiation path.

It is possible to apply the invention in further research areas. The metallic iris capillary may be used for formation of micro neutron beams. X-ray lithography and fabrication of miniature mechanical devices are further fields of application.

BRIEF DESCRIPTION OF THE FIGURES

One embodiment of the present invention is described by means of the attached drawings and by example only. In the drawings:

FIG. 6*a,b*: are elevational views showing the four rod members according to FIG. 1 mounted in the supporting tube according to FIG. 4, wherein FIG. 6*a* shows a spot like or quadrate geometry of the cross section of the iris capillary and FIG. 6*b* shows a rectangular or parallelogram geometry of the cross section of the iris capillary.

DETAILED DESCRIPTION OF THE INVENTION

Figure 1:
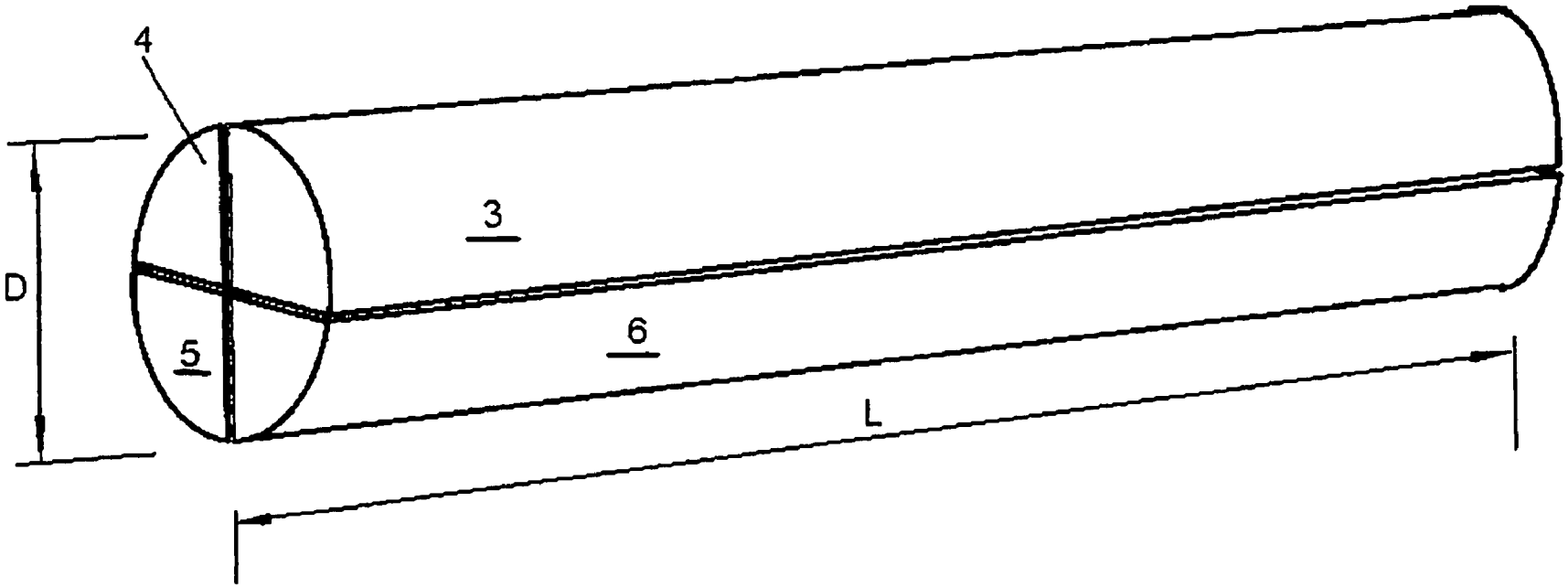
FIG. 1: is a perspective view of a tungsten rod longitudinally cut into four rod members according to the present invention.

In FIG. 1 a tungsten rod having a circular cross section, a length of L=200 mm and a diameter of D=10 mm is shown. In case of the present embodiment this tungsten rod is cut longitudinally into four identical pieces so that four identical rod members 3,4,5 and 6 each having a cross section of a 90°-arc sector are prepared. The angle extent of the arc sector of the cross section of the rod members 3,4,5 and 6 is smaller or larger than 90° if more or less than four rod members are prepared. Alternatively, the cross section of the rod members 3,4,5 and 6 may have any kind of appropriate shapes, for example triangle, quadrate or rectangular shape.

Figure 2:
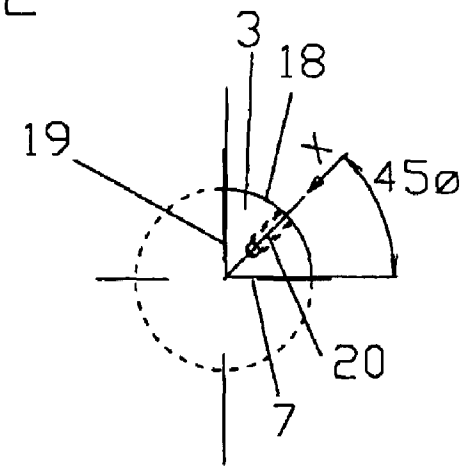
FIG. 2: is a cross sectional view of one of the rod members shown in FIG. 1.
Figure 3:
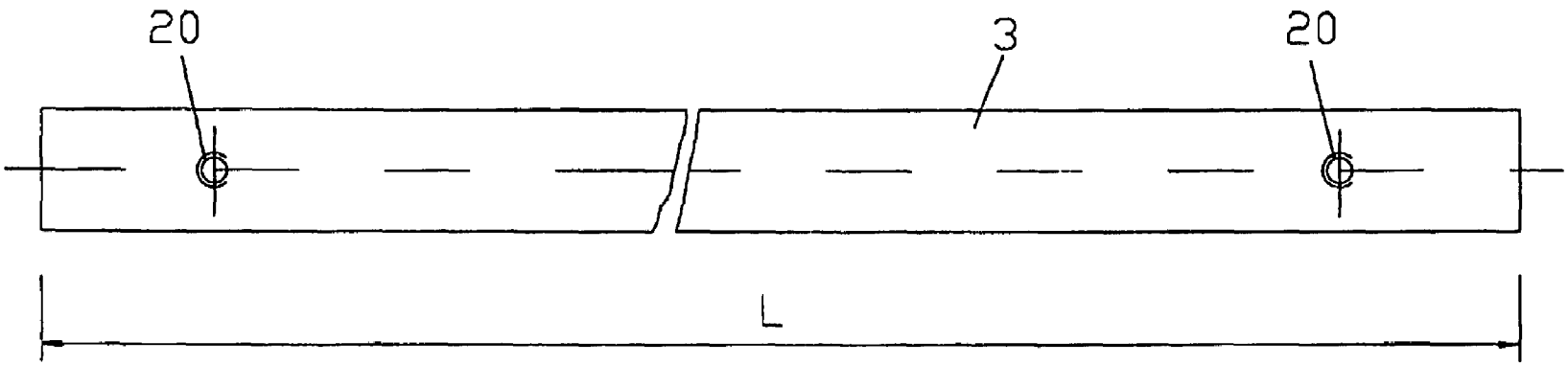
FIG. 3: is a side elevational view of the rod member shown FIG. 2 according to the view X in FIG. 2.

FIG. 2 shows a cross sectional view of rod member 3 in exemplary manner. The rod member 3 has a bordering surface 7 and a side surface 19 extending perpendicular to each other. Further, rod member 3 has a curved outer contact surface 18 which is engaged by adjustment screws as describe hereinafter. After careful construction, and if necessary, correction of the straightness and flatness of bordering surface 7 and side surface 19, the plane longitudinal bordering surface 7 is polished up to the final stage with OP-S colloidal silica suspension (grain size 0.04 μm). On the side of the curved outer contact surface 18 two threaded bores 20 have been machined in order to attach adjustment screws as described hereinafter. The two threaded bores 20 are lying in a plane enclosing an angle of 458 with both the plane of bordering surface 7 and the plane of side surface 19. As shown in FIG. 3, threaded bores 20 are located near the axial ends of rod member 3.

Figure 4:
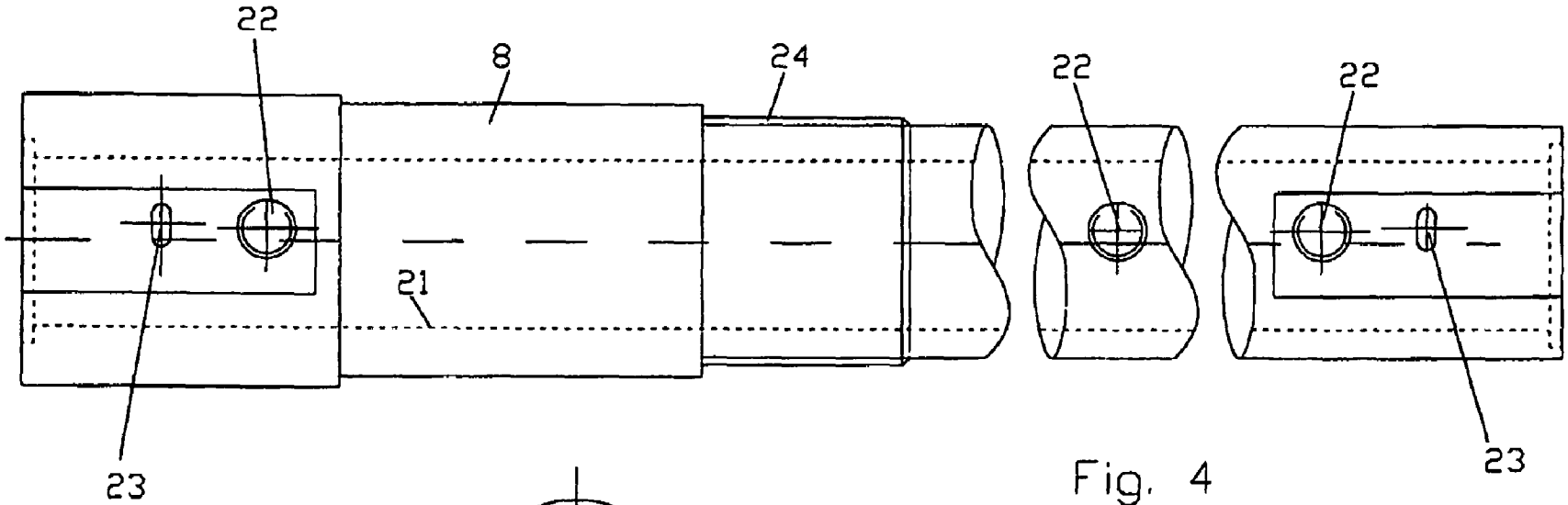
FIG. 4: is a side elevational view showing a supporting tube according to the present invention.

FIG. 4 shows a side elevational view of a supporting tube 8 preferably made of aluminum. Supporting tube 8 has a central bore 21 extending over the complete length as shown in broken lines. Twelve radial threaded bores 22 are penetrating supporting tube 8. Only three of the radial bores 22 may be seen in FIG. 4. Four of the radial threaded bores 22 are located in FIG. 4 at the left hand end of supporting tube 8 and four radial threaded bores 22 are located at the right hand end of supporting tube 8. Additionally, four radial threaded bores 22 are located in the axial middle portion of supporting tube 8 which can not be seen in FIG. 4 due to omission of some axial length of supporting tube 8 in FIG. 4. Further, at each end supporting tube 8 is penetrated by four radial elongated holes 23. An outer threaded portion 24 for connecting supporting tube 8 with a conventional gimbals system (not shown) is provided.

Figure 6B:
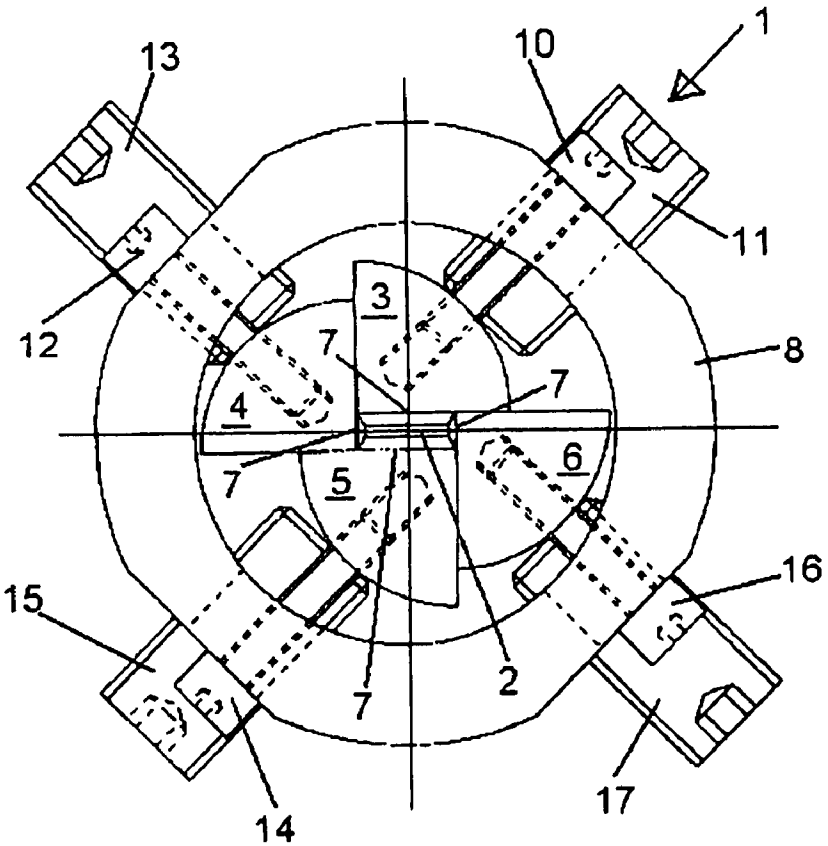
Figure 6A:
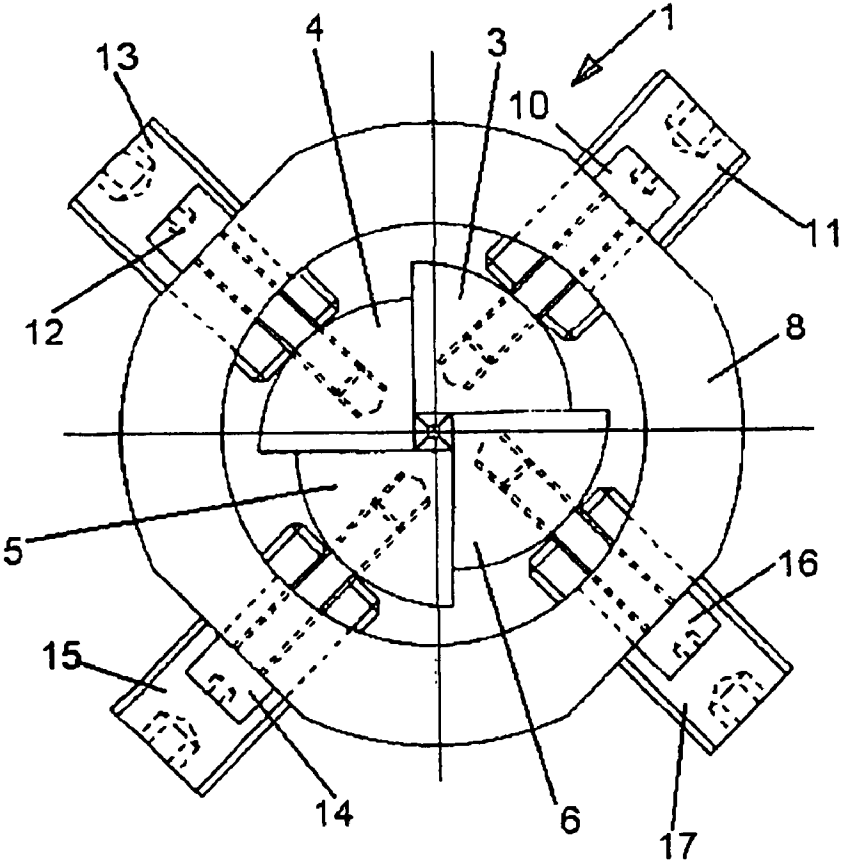

The four elongated rod members 3,4,5 and 6 are mounted in the supporting tube 8 as shown in FIG. 6*a,b*. As an auxiliary means for mounting the rod members 3,4,5, and 6 two centering rings (not shown) may be used. After placing the rod members 3,4,5 and 6 in the central bore 21 of supporting tube 8 these centering rings are at least partially inserted in the axial ends of supporting tube 8. The centering rings are protruding into central bore 21 at both ends of supporting tube 8 thereby enclosing the axial ends of rod members 3,4,5 and 6 and holding them in the center of central bore 21. Then, adjustment screws 10,12,14 and 16 are inserted into elongated holes 23 of supporting tube 8 for threaded engagement with threaded bores 20 in rod members 3,4,5 and 6. Adjustment screws 11,13,15 and 17 are threaded into radial threaded bores 22 of supporting tube 8 for the purpose of engaging outer contact surfaces 18 of rod members 3,4,5 and 6. As soon as at least some of the adjustment screws are holding the rod members 3,4,5 and 6 the auxiliary centering rings may be removed from the axial ends of supporting tube 8.

In the shown embodiment twelve adjustment screws of the type of screws 11,13,15 and 17 are used. Further, eight adjustment screws of the type of screws 10,12,14 and 16 are employed. As shown in FIG. 6*a,b*, the adjustment screws associated with adjacent rod members are circumferentially spaced by about 90°.

Figure 5:
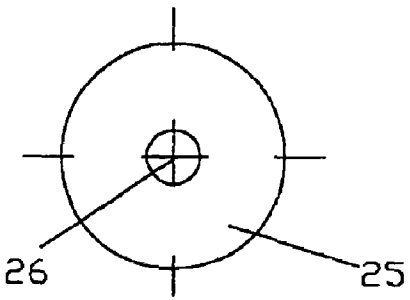
FIG. 5: is a side elevational view showing a closure disk for closing the radial space between the rod members and the supporting tube.

The bordering surfaces 7 of rod members 3,4,5 and 6 are polished so that they serve as elongated metallic mirrors having excellent total reflection properties for the purpose of the present invention. Accordingly, by using at adjustment screws 10–17 a radially closed elongated channel 2 with polished inner walls, i.e. a capillary, with quadrate (spot like) or parallelogram (rectangular) cross section and adjustable size at both the entrance end and the exit end of channel 2 can be formed very easily. The empty radial space between rod members 3,4,5 and 6 and supporting tube 8 may be covered at its axial ends by two round metallic closure disks 25 having a central hole 26 as shown in FIG. 5.

During the adjustment movement adjacent rod members are preferably in contact with each other along their plane longitudinal bordering surfaces 7 and their plane longitudinal side surfaces 19. It is not necessary to polish side surfaces 19 in the manner like bordering surfaces 7. Preferably, the contact between adjacent rod members is always between an unpolished side surface 19 and a polished bordering surface 7. Further, as can be seen in FIG. 6*a,b*, turning one or more of the adjustment screws is moving the respective rod member in a substantially radial direction.

In FIG. 6*a,b* the iris capillary or channel 2 is seen in the axial direction from its entrance end to its exit end. Accordingly, both cross sections the one at the entrance end having a larger size and the one at the exit end having a smaller size can be seen.

As is evident from the above description the present invention provides the following advantages:

Metallic iris capillary capable of operating as an X-ray concentrator with various radiation sources and wavelengths for generating micro beams with point or linear cross sections.

The metallic iris capillary includes metallic mirrors with excellent properties on X-ray optic phenomena, due to the high critical angle $\Theta_c$ for total reflection.

Stable construction against physical external forces.

Higher construction lengths allowing larger entrance openings for capturing most radiation available for concentration (compression).

No radiation leakage through the condenser walls do to the high-density construction material.

No heating effects affecting capillary size and transmitted intensity.

High stability against radiation damages.

Variable nominal input and output apertures of the iris capillary for maximum obtained intensity gain.

Variable length, thickness and cross section shape of the rod members (sector, triangle or quadrate).

Compact or coated with high electron density heavyweight metal as construction materials for the rod members.

The invention claimed is:

1. A micro beam collimator for compressing beams, comprising:

channel means for providing a channel, said channel having an entrance end, an exit end and a cross section, said channel means being arranged to guide said beams from said entrance end to said exit end of said channel; and at least three rod members, each of which having at least one bordering surface for bordering said cross section;

wherein said rod members form said channel means and are movable against each other along said bordering surfaces so that the geometry of said cross section is variable.

2. The micro beam collimator according to claim 1, further comprising a supporting tube in which said rod members are mounted, said supporting tube being disposed so as to provide a space between said rod members and said supporting tube in order to allow movements of said rod members for varying said geometry of said cross section.

3. The micro beam collimator according to claim 2, further comprising adjustment means for effecting said movements of said rod members for varying said geometry of said cross section.

4. The micro beam collimator according to claim 3, wherein said rod members are mounted in said supporting tube by said adjustment means only.

5. The micro beam collimator according to claim 3, wherein said adjustment means are provided at said entrance end of said channel and said adjustment means are provided at said exit end of said channel.

6. The micro beam collimator according to claim 5, wherein said adjustment means are further provided in a middle portion of said channel.

7. The micro beam collimator according to claim 3, wherein said adjustment means include adjustment screws penetrating said supporting tube.

8. The micro beam collimator according to claim 7, wherein said adjustment means include at least four pairs of adjustment screws, each pair having a first adjustment screw and a second adjustment screw and being associated with one of the rod members, the first adjustment screw of each pair engaging a threaded hole in said one associated rod member and the second adjustment screw of each pair engaging an outer contact surface of said one associated rod member.

9. The micro beam collimator according to claim 1, wherein four rod members form said channel means.

10. The micro beam collimator according to claim 1, wherein said rod members are bendable for adjusting different sizes of said cross section at said entrance end and said exit end of said channel.

11. The micro beam collimator according to claim 1, wherein said rod members are twistable for adjusting an orientation of said cross section at said entrance end and said exit end of said channel.

12. The micro beam collimator according to claim 1, wherein said rod members have a cross section of sector shape.

13. The micro beam collimator according to claim 1, wherein said rod members have a cross section of triangle shape.

14. The micro beam collimator according to claim 1, wherein said rod members have a cross section of quadrate shape.

15. A micro beam collimator for compressing beams, comprising:

channel means for providing a channel, said channel having an entrance end, an exit end and a cross section, said channel means being arranged to guide said beams from said entrance end to said exit end of said channel; and at least three rod members, each of which having at least one bordering surface for bordering said cross section;

wherein said rod members form said channel means, said rod members are movable against each other along said bordering surfaces so that a geometry of said cross section is variable, said rod members are bendable for adjusting different sizes of said cross section at said entrance end and said exit end of said channel, and said rod members are twistable for adjusting an orientation of said cross section at said entrance end and said exit end of said channel.

16. A micro beam collimator for compressing beams, comprising:

at least three rod members, each of which having at least one bordering surface;

a supporting tube in which said rod members are mounted; and at least three adjusters, each of which being operatively associated to one of said at least three rod members;

wherein said rod members are movable against each other along said bordering surfaces and within said supporting tube by means of said adjusters so as to define a channel having an entrance end, an exit end and a cross section, whereby the geometry of said cross section is variable.

17. The micro beam collimator according to claim 16, wherein said rod members are bendable for adjusting different sizes of said cross section at said entrance end and said exit end of said channel.

18. The micro beam collimator according to claim 16, wherein said rod members are twistable for adjusting the orientation of said cross section at said entrance end and said exit end of said channel.

19. The micro beam collimator according to claim 16, wherein said rod members are mounted in said supporting tube by said adjusters only.

20. The micro beam collimator according to claim 16, comprising four rod members.

* * * * *